United States Patent [19]

Lumpkin, Jr.

[11] 4,101,263

[45] Jul. 18, 1978

[54] METHOD FOR HEATING NONGASEOUS CARBONACEOUS MATERIAL

[75] Inventor: Robert E. Lumpkin, Jr., Claremont, Calif.

[73] Assignee: Occidental Petroleum Corporation, Los Angeles, Calif.

[21] Appl. No.: 700,006

[22] Filed: Jun. 25, 1976

[51] Int. Cl.[2] ..... F27D 13/00; C10B 49/12

[52] U.S. Cl. ..... 432/13; 432/58; 432/14; 34/57 E; 34/10; 201/13; 201/32; 201/33; 201/25; 48/DIG. 4; 110/263; 110/347; 23/284

[58] Field of Search ..... 201/13, 32, 33, 25; 48/DIG. 4, 109, 210; 431/9.5, 173; 110/28 F; 23/284; 34/57 E; 55/349, 237; 432/13, 58

[56] References Cited

U.S. PATENT DOCUMENTS

| | | | |
|---|---|---|---|
| 2,038,657 | 4/1936 | Hillhouse | 48/DIG. 4 |
| 2,530,077 | 11/1950 | Ramsing | 23/259.5 UX |
| 2,707,444 | 5/1955 | Van Loon | 110/28 F |
| 2,739,104 | 3/1956 | Galbreath et al. | 201/33 X |
| 2,874,092 | 2/1959 | Beuther et al. | 201/33 X |
| 3,064,811 | 11/1962 | Mumper | 209/144 |
| 3,494,047 | 2/1970 | Geiger et al. | 34/57 E |
| 3,526,483 | 9/1970 | Deussner et al. | 23/284 |
| 3,579,850 | 5/1971 | Deussner et al. | 34/57 E |

*Primary Examiner*—James H. Tayman, Jr.
*Attorney, Agent, or Firm*—Forrest E. Logan

[57] ABSTRACT

Nongaseous carbonaceous material is heated by a method comprising introducing tangentially a first stream containing a nongaseous carbonaceous material and carbon monoxide into a reaction zone; simultaneously and separately introducing a second stream containing oxygen into the reaction zone such that the oxygen enters the reaction zone away from the wall thereof and reacts with the first stream thereby producing a gaseous product and heating the nongaseous carbonaceous material; forming an outer spiralling vortex within the reaction zone to cause substantial separation of gases, including the gaseous product, from the nongaseous carbonaceous material; removing a third stream from the reaction zone containing the gaseous product which is substantially free of the nongaseous carbonaceous material before a major portion of the gaseous product can react with the nongaseous carbonaceous material; and removing a fourth stream containing the nongaseous carbonaceous material from the reaction zone.

23 Claims, 6 Drawing Figures

METHOD FOR HEATING NONGASEOUS CARBONACEOUS MATERIAL

BACKGROUND OF THE INVENTION

Many processes are known for the conversion of nongaseous carbonaceous material into gaseous, liquid and solid products. For example, nongaseous carbonaceous material may be converted by carbonization at temperatures above 900° F. Pyrolysis of nongaseous carbonaceous material in an entrained bed reactor, or transport reactor, has the advantage of limiting the pyrolysis to short residence times. Short residence times enhances the quality and/or yield of gaseous and liquid products which tend to decompose under longer residence times carbonization processes.

Carbonization at short residence times, often referred to as flash pyrolysis or simply pyrolysis, requires rapid heating of the nongaseous carbonaceous material. One method used in pyrolysis to achieve rapid heating is to simultaneously introduce with the nongaseous carbonaceous material a heat-supplying medium, or heating medium, to the pyrolysis zone which becomes intimately mixed with the fresh nongaseous carbonaceous material. Since most pyrolysis processes also produce a solid product, or carbonaceous residue, or char, or coke, it is economical to utilize the solid product as the heat-supplying medium.

The solid product can be heated in a heating zone or zones to a temperature greater than the pyrolysis temperature and recycled to the pyrolysis zone as the heating medium. The solid product can be heated in the heating zone, or reaction zone, by partial oxidation. Partial oxidation consumes a portion of the solid product and produces a gaseous product and thermal energy which is transferred in part to the residual solid product. The gaseous product produced contains carbon dioxide and often gaseous $H_2O$ and carbon monoxide. The gaseous product if not immediately separated from the solid product, or nongaseous carbonaceous material, will react with the solid product and produce additional carbon monoxide. Carbon monoxide formation reactions are endothermic and tend to remove sensible heat from the system and are therefore to be avoided if possible.

In many processes, however, it is necessary to transport the solid product, or char, or nongaseous carbonaceous material to the heating zone. Often the transport line is also used as a first stage heating zone. When the transport line is used as a heating zone there is frequently substantial carbon monoxide present with the stream as it enters the second stage heating zone.

The invention is useful especially when applied to the second stage heating zone. The invention is an apparatus and method to produce additional heating of the nongaseous carbonaceous material by oxidation of at least a portion of the carbon monoxide introduced to the heating zone to carbon dioxide and transferring the thermal energy released by oxidation reaction at least in part to the nongaseous carbonaceous material thereby increasing the temperature thereof and thereby producing a heat-supplying medium.

More specifically, pyrolysis processes are used to convert particulate carbonaceous material such as coal, either coking or noncoking coal, or agglomerative or nonagglomerative coal, to a valuable gaseous product and char product. The gaseous product can be cooled to produce a valuable liquid product. The char product can be heated separately by partial oxidation to raise the residual char to a higher temperature. The heated char can then be recycled to the pyrolysis zone to supply at least a portion of the heat required for pyrolysis.

Other pyrolysis processes, which utilize heated solid product as a heat-supplying medium are processes for the pyrolysis of waste materials, such as municipal solid waste and industrial solid waste.

This invention is useful in processes for heating a nongaseous carbonaceous material to a higher temperature so that it can be utilized as a heat supplying medium. This invention is also useful in processes for pyrolyzing nongaseous carbonaceous material in a pyrolysis zone, separating the solid product or char from the gaseous product, heating the char in a heating zone to a temperature sufficiently high to produce a heat-supplying medium, and recycling the heat-supplying medium to pyrolysis zone to supply heat thereto.

SUMMARY OF THE INVENTION

This invention covers in part a process and apparatus for heating nongaseous carbonaceous material by introducing a stream containing a nongaseous carbonaceous material and carbon monoxide tangentially into a reaction zone. Simultaneously and separately introducing a second stream containing oxygen into the reaction zone but away from the wall or boundary of the reaction zone. The oxygen so introduced reacts in part with the carbon monoxide producing carbon dioxide and generating thermal energy which in part is transferred to the nongaseous carbonaceous material.

Simultaneously with the reaction an outer spiralling vortex is formed in the reaction zone which substantially separates the gases including the gaseous product containing carbon dioxide and possibly gaseous $H_2O$ from the nongaseous carbonaceous material.

Further simultaneously with the reaction, a third stream which is substantially free of nongaseous carbonaceous material and essentially gaseous and containing the gaseous product is removed from the reaction zone before a major portion of the gaseous product, or carbon dioxide, can react with the nongaseous carbonaceous material.

Simultaneously, a fourth stream containing the heated nongaseous carbonaceous material is removed from the reaction zone. The heated nongaseous carbonaceous material is useful as a heat-supplying medium.

More particularly this invention covers in part a process and apparatus for heating particulate carbonaceous material by introducing a stream containing particulate carbonaceous material and a carrier gas containing carbon monoxide into a reaction zone. Simultaneously and separately introducing a second stream containing oxygen into the reaction zone but away from the wall or boundary of the reaction zone. The oxygen so introduced reacts in part with the carbon monoxide producing carbon dioxide and generating thermal energy which in part is transferred to the particulate carbonaceous material.

Simultaneously with the reaction an outer spiralling vortex is formed in the reaction zone which substantially separates the gases including the gaseous product and the carrier gas from the particulate carbonaceous material.

Further simultaneously with the reaction a third stream which is substantially free of particulate carbonaceous material and essentially gaseous and containing the gaseous product and the carrier gas is removed from the reaction zone within a period of time sufficiently short that the carbon monoxide content of the third stream is less than the combined carbon monoxide content of the first and second streams entering the reaction zone. Preferably the second stream does not contain carbon monoxide.

Simultaneously a fourth stream containing the heated particulate carbonaceous material is removed from the reaction zone. The heated particulate carbonaceous material is useful as a heat-supplying medium, and is especially useful in flash pyrolysis processes which utilize a heat-supplying medium to achieve rapid heat transfer to the fresh carbonaceous material to be carbonized.

The process may be conducted in a reactor having a covered cylindrical chamber which is attached to a conical portion at a point opposite the covered end of the covered cylindrical chamber. An inlet is provided for directing a first stream containing a nongaseous carbonaceous material tangentially into the covered cylindrical chamber such that the nongaseous material forms an outer spiralling vortex which is urged or flows towards the conical portion and such that the nongaseous material is substantially separated from gases.

A means is provided for simultaneously and separately introducing a second stream containing gaseous oxygen into the reactor away from the wall thereof. The means communicates with the reactor at a point removed from the covered end of the reactor to enhance the oxidation of carbon monoxide in preference to the nongaseous carbonaceous material.

A first outlet is provided which is located in the covered end of the covered cylindrical chamber, and oriented along the axis thereof and in communication therewith, for removing gases substantially separated from the nongaseous material, and for forming an inner spiralling gaseous vortex. A second outlet is provided which is located at the smaller diameter end of the conical portion and which is in communication with the conical portion from removing nongaseous material.

In a preferred embodiment the means for introducing the second stream containing gaseous oxygen into the reactor away from the walls thereof and below the covered end thereof, also provides for introducing along the axis thereof. An alternative and also preferred embodiment of the means for introducing a second stream containing gaseous oxygen into the reactor provides for causing the second stream to enter the reactor in an annular flow pattern about the axis thereof.

BRIEF DESCRIPTION OF THE DRAWINGS

The invention, including various novel features, will be more fully understood by reference to the accompanying drawings and the following description of the operation of the alternatives illustrated therein.

DETAILED DESCRIPTION OF THE PREFERRED EMBODIMENT

Figure 1:
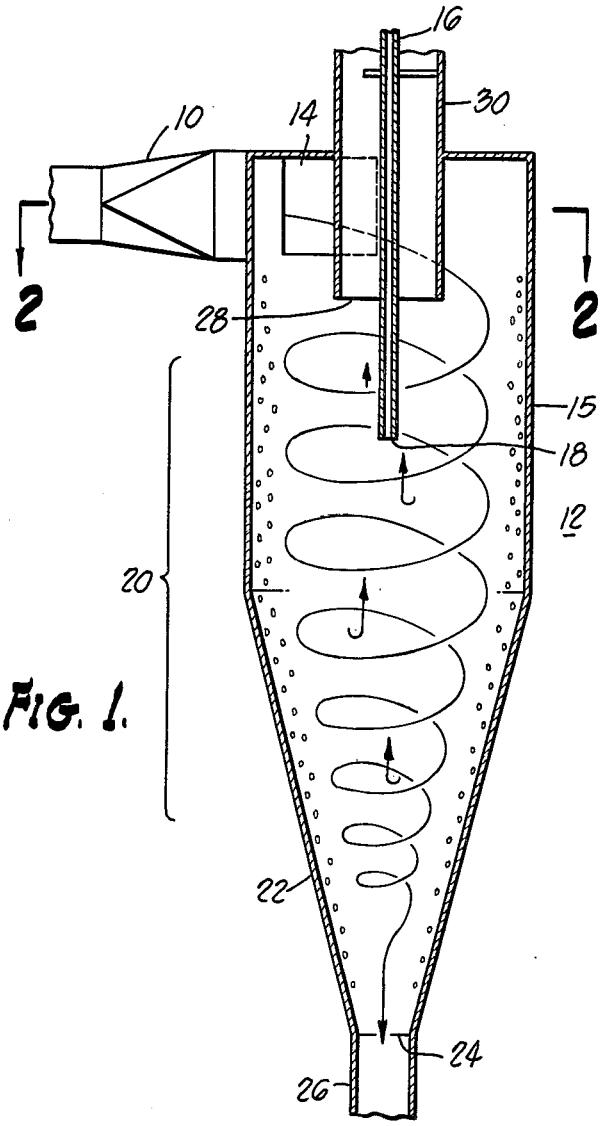
FIG. 1 is a schematic diagram of one embodiment of the invention for treating nongaseous carbonaceous material wherein the means for introducing the stream containing gaseous oxygen into the reactor comprises a conduit through the gas outlet to the reactor.
Figure 2:
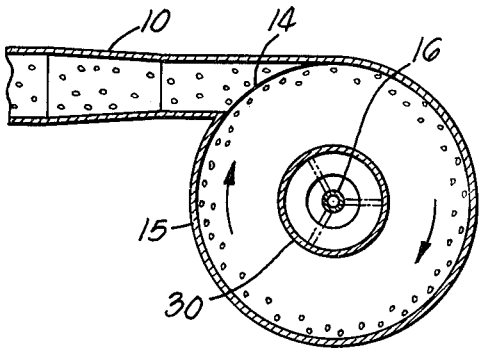
FIG. 2 is a view of the invention in FIG. 1 through the line marked 2—2.

By nongaseous carbonaceous material is meant any material which contains carbon which is not in the gaseous state.

By oxygen is meant any source of oxygen. The oxygen need not be in the pure state, but may be a part of a stream such that oxygen from the stream is available for the partial oxidation of the nongaseous carbonaceous material. Such oxygen may be a gas mixture which contains therein free oxygen, such as air.

Referring now to the drawings, nongaseous carbonaceous material, such as char produced from the flash pyrolysis of coal or waste materials, entrained in a carrier gas containing carbon monoxide is introduced into conduit 10. From conduit 10 the char and carrier gas enter reactor 12 through opening 14 in the covered cylindrical chamber 15 of reactor 12.

Oxygen, or preferrably air, is introduced continuously and simultaneously into conduit 16 and enters reactor 12 through opening 18. The carbon monoxide and oxygen react in reaction zone 20 contained within reactor 12. Although air is the preferred source of oxygen, the oxygen may be supplied from any source of oxygen, such as a gas stream containing gaseous oxygen such as air, or a flue gas enriched with air or oxygen.

Centrifugal force causes the char to spiral inside reactor 12 and form an outer spiralling vortex in such a manner that the char is confined along the wall of the reactor 12 while the gases are caused to separate from the char. The char flows from the covered chamber 15 of the reactor towards conical portion 22 of the reactor and is removed from the reactor through opening 24 located at the smaller diameter end of conical portion 22. From opening 24 the char flows into conduit 26.

Gases substantially separated from the char are continuously removed from reactor 12, through opening 28 in conduit 30. The positioning of conduit 30 and opening 28 enables the formation of an inner spiralling vortex which is substantially free of nongaseous material.

As a result of the release of thermal energy inside reactor 12 produced in part by the oxidation of carbon monoxide to carbon dioxide, the char passing through opening 24 and into conduit 26 is at a higher temperature than the char entering the reactor through conduit 10. Char removed through conduit 26 is useful and a heat-supplying medium to such processes as flash pyrolysis having as feed stocks nongaseous carbonaceous material.

Figure 3:
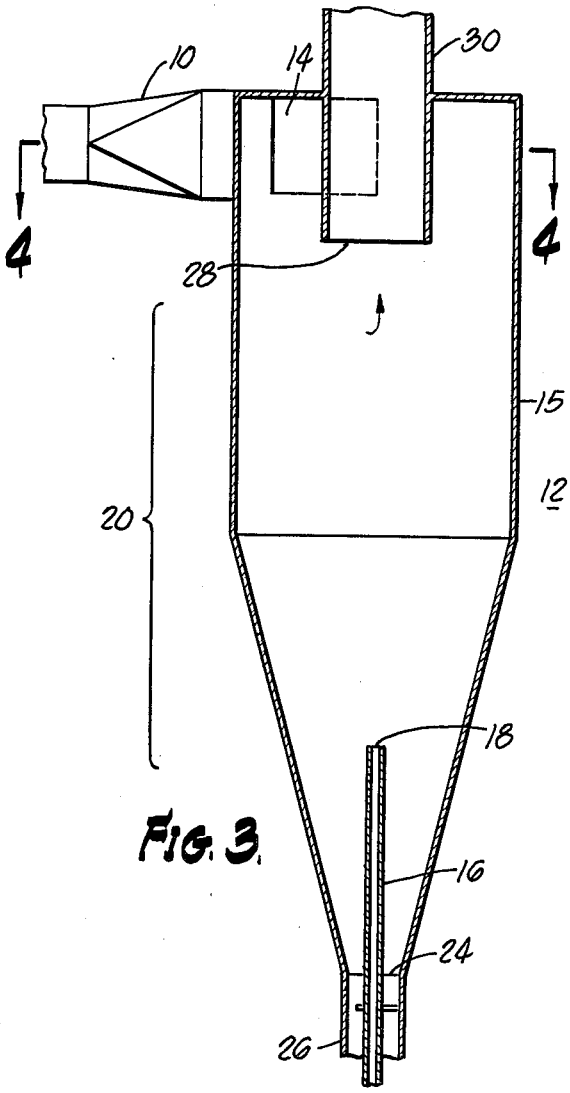
FIG. 3 is an alternate embodiment of the invention for treating nongaseous carbonaceous material wherein the means for introducing the stream containing gaseous oxygen into the reactor comprises a conduit through the outlet located at the smaller diameter end of the conical portion.
Figure 4:
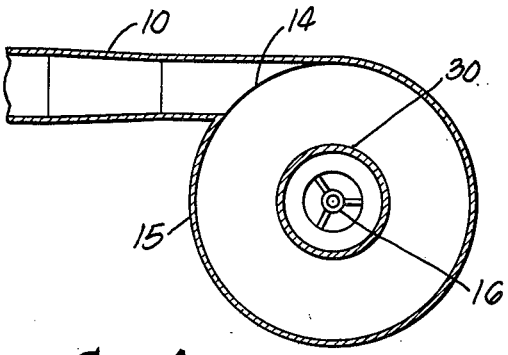
FIG. 4 is a view of FIG. 3 through line 4—4.

In FIG. 3 air enters through a conduit 16 and opening 18. The air is introduced into reactor 12 away from the wall thereof, away from the covered end of covered cylindrical chamber 15, and axially and is positioned through opening 24 in conduit 26.

Figure 5:
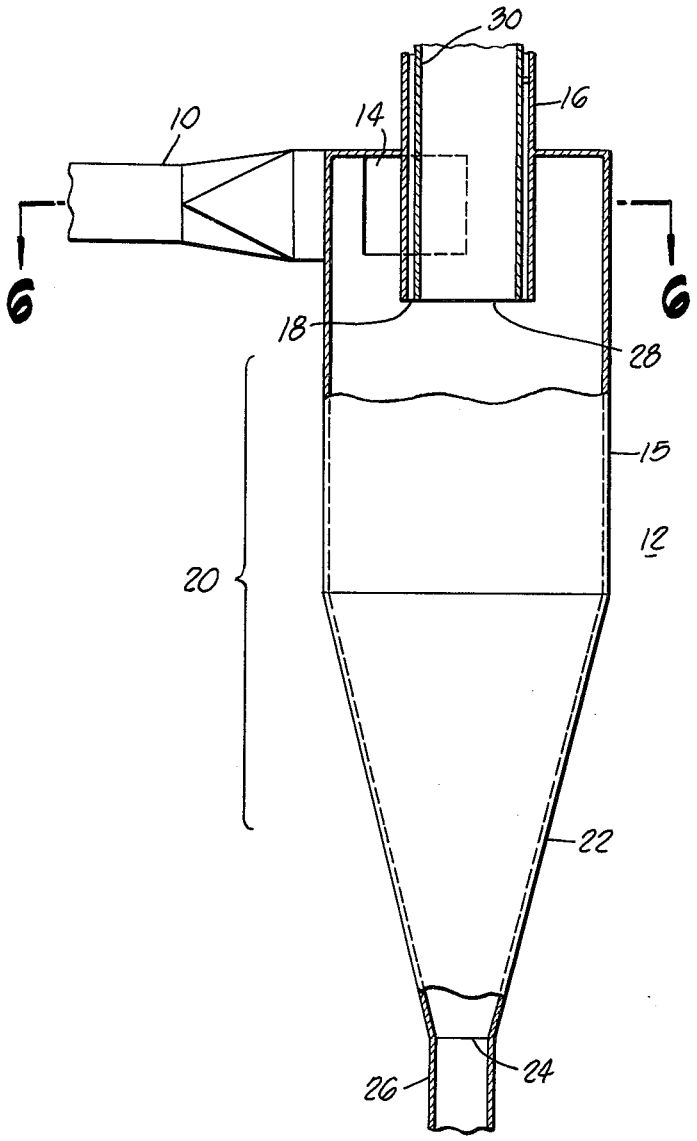
FIG. 5 is a third embodiment of the invention for treating nongaseous carbonaceous material wherein the means for introducing the stream containing gaseous oxygen into the reactor comprises a conduit which is concentric to the gas outlet conduit and extends into the reactor a distance equal to the distance that the gas outlet extends into the reactor.
Figure 6:
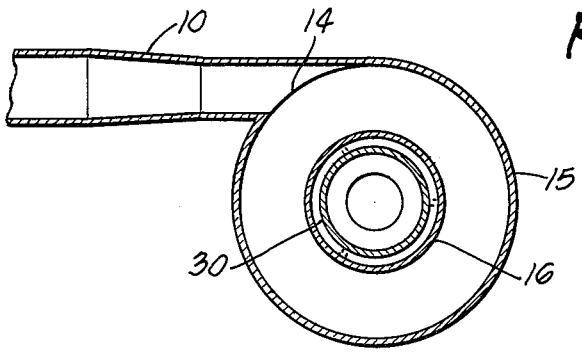
FIG. 6 is a view in FIG. 5 through line 6—6.

In the embodiment shown in FIG. 5 air conveyed through conduit 16, which is concentric to conduit 30, enters reactor 12 through opening 18. The air is introduced into reactor 12 away from the wall thereof and the covered end of covered cylindrical chamber 15. In this embodiment, air enters the reactor in an annular flow pattern about the axis thereof.

In all embodiments, air or the second stream containing oxygen is introduced in such a manner as to not lower substantially the efficiency of separation of the char or nongaseous material from the gases below the level which would be realized if the second stream were not introduced into the reactor. If it is desirable to adjust the "cut point" to remove fines from the char separated by the reactor, this can be done by appropriate selection of the dimension of the reactor as known to those skilled in the art. Fine removal by this technique enhances oxidation of the fines and generation of additional thermal energy which in part is transferred to the char removed through conduit 26.

By "substantially free of, or substantially separated from, nongaseous or particulate carbonaceous material" herein is meant that the gaseous stream is substantially free of particles larger than about ten microns, except if the cut point is designed to be larger than ten microns, then by "substantially free of, or substantially separated from, nongaseous or particulate carbonaceous material" herein is meant that the stream is substantially free of particles larger than about the cut point size.

Particles less than ten microns are extremely difficult to separate with centrifugal devices which are larger than laboratory size.

The term "cut point" is well known in the art and generally is understood to mean the particular particle size for which the centrifugal device separates 50% of that particular particle size from the gaseous stream.

In the embodiment shown in FIG. 1 conduit 16 must extend into reactor 12 at least to the same length that conduit 30 extends into the reactor. Conduit 16 can extend further into the reactor than opening 28 and can terminate somewhere within conical portion 22. However, opening 18 should not be so close to opening 24 that the air reentrains particulate carbonaceous material which has been substantially separated from the gases.

Similarly for the embodiment shown in FIG. 3, conduit 16 must extend into conical section 22 for a length sufficient to prevent reentrainment of separated particulate material spiralling down the conical portion 22 in the inner spiralling vortex. Conduit 16 may extend into the covered cylindrical portion 15 of reactor 12 but must not extend so far into covered cylindrical portion 15 so as to prevent air, or the stream containing oxygen, from substantially reacting inside the reactor with the carbon monoxide introduced through conduit 10. This is necessary to permit the transfer of thermal energy to char.

In FIG. 5, conduit 16 must extend into reactor 12 away from, or beyond, the covered end of covered cylindrical chamber 15 of reactor 12. Conduit 16 must not, however, extend beyond conduit 30. If conduit 16 extends beyond opening 28 then the transfer of thermal energy released by the reaction of the air, or oxygen, with carbon monoxide to the char is substantially diminished.

In all embodiments conduit 30 causes an inner spiralling gaseous vortex which is substantially free of particulate carbonaceous material to be formed. Gaseous material is removed from reactor 12 before a major portion of the gaseous product, principally carbon dioxide, can react with the particulate carbonaceous material. In other words the gases are removed from the reaction zone 20 within a period of time sufficiently short that the carbon monoxide content of the third stream leaving conduit 30 is less than the combined carbon monoxide content of the first and second streams entering through openings 14 and 18 respectively. Preferably the second stream does not contain any carbon monoxide.

It can be appreciated that the reaction of the gaseous products becomes more favorable for higher temperatures and at higher temperatures the advantages of this efficient process are realized. In the preferred embodiment the carbonaceous material is introduced into the reaction zone at a temperature of about 1300° F or higher. At this temperature appreciable reaction of the gaseous product, carbon dioxide, with the char will occur unless the gaseous product is separated therefrom very rapidly.

Particulate carbonaceous material which can be heated in the apparatus and process disclosed herein is the solid product from the carbonization of waste materials such as all types of coal, or coal like substances such as anthracite coal, bituminous coal, subbituminous coal, lignite and peat, or other forms of carbonaceous material such as municipal waste or garbage, or industrial waste such as tree bark, scrap rubber, rubber tires, sugar, refinery waste, saw dust, corn cobs, rice hulls, animal matter from slaughter houses, used or waste petroleum products and other nongaseous carbonaceous material.

The nature and objects of the invention can be more fully understood by considering the following examples.

EXAMPLE 1

Coal char produced by pyrolysis of coal is introduced into a reactor as shown in FIG. 1 through conduit 10, at a rate of 817 lbs/sec. entrained in a carrier gas at a mixed temperature of 1616° F. The carrier is introduced at a rate of 3.206 pound moles/sec. and is composed of 77.55 mole percent nitrogen, 20.07 mole percent carbon monoxide, and 2.40 mole percent carbon dioxide.

Air is introduced through conduit 16 at a rate of 0.321 pound moles/sec. at a temperature of 1616° F.

The diameter of the reactor is 20 ft. and the height is 60 ft. The average gaseous residence time in the reactor, defined as the volume of the reactor divided by the volumetric flow rate, is about one second.

The diameter of conduit 30 is about 10 ft. and conduit 16 about 6 inches.

EXAMPLE 2

In an application where the reactor is also used as a primary heater the carrier gas can contain oxygen as it enters the reactor. Oxygen introduced in the second stream will then act to oxidize carbon monoxide present in the reactor. The following is an example of this mode of operation.

Coal char produced by pyrolysis of coal is introduced into a reactor as shown in FIG. 5 through conduit 10, at a rate of 817 lbs/sec. entrained in a carrier gas at a mixed temperature of 1616° F. The carrier is introduced at a rate of 3.206 pound moles/sec. and is composed of 77.55 mole percent nitrogen, 3.67 mole percent carbon monoxide, 0.44 mole percent carbon dioxide and 18.34 mole percent oxygen.

Air is introduced through conduit 16 at a rate of 0.321 pound moles/sec. at a temperature of 1785° F.

The diameter of the reactor is 20 ft. and the height is 60 ft. The average gaseous residence time in the reactor, defined as the volume of the reactor divided by the volumetric flow rate, is about one second.

The diameter of conduit 30 is about 9.5 ft. and conduit 16 about 10 ft.

While I have disclosed the preferred embodiment of my invention, it is to be understood that the details thereof may be varied within the scope of the following claims.

What is claimed is:

1. A process for heating nongaseous carbonaceous material comprising:

a. introducing tangentially a first stream containing a nongaseous carbonaceous material and carbon monoxide into a reactor structure comprising:
   i. a reactor having a covered cylindrical chamber,
   ii. a conical portion attached to said covered cylindrical chamber opposite the covered end thereof and in communication therewith,
   iii. a first inlet means for directing a first stream containing a nongaseous carbonaceous material tangentially into said covered cylindrical chamber and for causing nongaseous material to form an outer spiralling vortex which is urged towards said conical portion and for causing nongaseous material to be substantially separated from gases,
   iv. a second inlet means for simultaneously and separately introducing a second stream containing gaseous oxygen into said reactor away from the walls thereof, said second inlet means communicating with said reactor at a point removed from the covered end thereof,
   v. a first outlet means located in the covered end of said covered cylindrical chamber, and oriented along the axis thereof and in communication therewith, for removing gases substantially separated from nongaseous material, and for forming an inner spiralling gaseous vortex, and
   vi. a second outlet means located at the smaller diameter end of said conical portion and in communication therewith for removing nongaseous material;

b. forming an outer spiralling vortex within said reactor to cause substantial separation of gases from said nongaseous carbonaceous material;

c. simultaneously and separately introducing a second stream containing oxygen into said reactor through said second inlet means and internally of said outer spiralling vortex, and reacting said oxygen with said first stream thereby producing a gaseous product comprising carbon dioxide and producing a heated nongaseous carbonaceous material;

d. removing a third stream from said reactor, through said first outlet means, containing said gaseous product which is substantially free of said nongaseous carbonaceous material before a major portion of said gaseous product comprising carbon dioxide can react with said nongaseous carbonaceous material; and e. removing a fourth stream containing said heated nongaseous carbonaceous material which is a major portion of said nongaseous carbonaceous material introduced in step (a) from said reaction zone through said second outlet means.

2. A process for heating gaseous carbonaceous material, as recited in claim 1, wherein said second inlet means introduces said second stream into said inner spiralling vortex.

3. A process for heating nongaseous carbonaceous material comprising:

a. introducing tangentially a first stream containing a nongaseous carbonaceous material and carbon monoxide into a reactor structure comprising:
   i. a reactor having a covered cylindrical chamber,
   ii. a conical portion attached to said covered cylindrical chamber opposite the covered end thereof and in communication therewith,
   iii. a first inlet means for directing a first stream containing a nongaseous carbonaceous material tangentially into said covered cylindrical chamber and for causing nongaseous material to form an outer spiralling vortex which is urged towards said conical portion and for causing nongaseous material to be substantially separated from gases,
   iv. a second inlet means for simultaneously and separately introducing a second stream containing gaseous oxygen into said reactor away from the walls thereof, said second inlet means communicating with said reactor at a point removed from the covered end thereof, and along the axis thereof,
   v. a first outlet means located in the covered end of said covered cylindrical chamber, and oriented along the axis thereof and in communication therewith, for removing gases substantially separated from nongaseous material, and for forming an inner spiralling gaseous vortex, and
   vi. a second outlet means located at the smaller diameter end of said conical portion and in communication therewith for removing nongaseous material;

b. forming an outer spiralling vortex within said reactor to cause substantial separation of gases from said nongaseous carbonaceous material;

c. simultaneously and separately introducing a second stream containing oxygen into said reactor through said second inlet means and internally of said outer spiralling vortex, and reacting said oxygen with said first stream thereby producing a gaseous product comprising carbon dioxide and producing a heated nongaseous carbonaceous material;

d. removing a third stream from said reactor, through said first outlet means, containing said gaseous product which is substantially free of said nongaseous carbonaceous material before a major portion of said gaseous product comprising carbon dioxide can react with said nongaseous carbonaceous material; and e. removing a fourth stream containing said heated nongaseous carbonaceous material which is a major portion of said nongaseous carbonaceous material introduced in step (a) from said reaction zone through said second outlet means.

4. A process for heating nongaseous carbonaceous material, as recited in claim 3, wherein said second inlet means comprises a conduit through said first outlet means and positioned along the axis thereof.

5. A process for heating nongaseous carbonaceous material, as recited in claim 3, wherein said second inlet means comprises a conduit through said second outlet means and positioned along the axis thereof.

6. A process for heating nongaseous carbonaceous material comprising:

a. introducing tangentially a first stream containing a nongaseous carbonaceous material and carbon monoxide into a reactor structure comprising:
   i. a reactor having a covered cylindrical chamber,
   ii. a conical portion attached to said covered cylindrical chamber opposite the covered end thereof and in communication therewith,
   iii. a first inlet means for directing a first stream containing a nongaseous carbonaceous material tangentially into said covered cylindrical chamber and for causing nongaseous material to form an outer spiralling vortex which is urged towards said conical portion and for causing nongaseous material to be substantially separated from gases,
   iv. a second inlet means for simultaneously and separately introducing a second stream containing gaseous oxygen into said reactor away from the walls thereof, said second inlet means communicating with said reactor at a point removed from the covered end thereof, and for causing said second stream to enter said reactor in an annular flow pattern about the axis thereof,
   v. a first outlet means located in the covered end of said covered cylindrical chamber, and oriented along the axis thereof and in communication therewith, for removing gases substantially separated from nongaseous material, and for forming an inner spiralling gaseous vortex, and
   vi. a second outlet means located at the smaller diameter end of said conical portion and in communication therewith for removing nongaseous material;
b. forming an outer spiralling vortex within said reactor to cause substantial separation of gases from said nongaseous carbonaceous material;
c. simultaneously and separately introducing a second stream containing oxygen into said reactor through said second inlet means and internally of said outer spiralling vortex, and reacting said oxygen with said first stream thereby producing a gaseous product comprising carbon dioxide and producing a heated nongaseous carbonaceous material;
d. removing a third stream from said reactor, through said first outlet means, containing said gaseous product which is substantially free of said nongaseous carbonaceous material before a major portion of said gaseous product comprising carbon dioxide can react with said nongaseous carbonaceous material; and
e. removing a fourth stream containing said heated nongaseous carbonaceous material which is a major portion of said nongaseous carbonaceous material introduced in step (a) from said reaction zone through said second outlet means.

7. A process for heating nongaseous carbonaceous material, as recited in claim 6, wherein said second inlet means is also for causing an annular flow pattern about said first outlet means and concentric thereto.

8. A process for heating nongaseous carbonaceous material, as recited in claim 6, wherein said second inlet means is also for causing said second stream to enter said reactor in a swirling annular flow pattern.

9. A process for heating nongaseous carbonaceous material, as recited in claim 6, wherein said second inlet means is a conduit concentric to said first outlet means and extending into said reactor for a distance no greater than said first outlet means extends into said reactor.

10. A process for heating nongaseous carbonaceous material, as recited in claim 6, wherein said second inlet means comprises a conduit concentric to said first outlet means and extending into said reactor for a distance equal to the distance that said first outlet means extends into said reactor.

11. A process for heating nongaseous carbonaceous material comprising:
a. introducing tangentially a first stream containing a nongaseous carbonaceous material and carbon monoxide into a reaction zone;
b. forming an outer spiralling vortex within said reaction zone to cause substantial separation of gases from said nongaseous carbonaceous material;
c. simultaneously and separately introducing a second stream containing oxygen into said reaction zone and causing said oxygen to enter said reaction zone away from the wall thereof and internally of said outer spiralling vortex and reacting said oxygen with said first stream thereby producing a gaseous product comprising carbon dioxide and producing a heated nongaseous carbonaceous material;
d. removing a third stream from said reaction zone containing said gaseous product which is substantially free of said nongaseous carbonaceous material before a major portion of said gaseous product comprising carbon dioxide can react with said nongaseous carbonaceous material; and
e. removing a fourth stream containing said heated nongaseous carbonaceous material which is a major portion of said nongaseous carbonaceous material introduced in step (a), from said reaction zone.

12. A process for heating nongaseous carbonaceous material, as recited in claim 11, wherein said second stream is introduced into said reaction zone along the axis of said reaction zone.

13. A process for heating nongaseous carbonaceous material, as recited in claim 11, wherein said second stream is introduced into said reaction zone in an annular flow pattern about said third stream and isolated from said third stream.

14. A process for heating nongaseous carbonaceous material, as recited in claim 11, wherein said annular flow pattern is also swirling.

15. A process for heating particulate carbonaceous material comprising:
a. introducing tangentially a first stream containing a particulate carbonaceous material and a carrier gas containing carbon monoxide into a reaction zone;
b. forming an outer spiralling vortex within said reaction zone to cause substantial separation of gases, including said carrier gas, from said particulate carbonaceous material;
c. simultaneously and separately introducing a second stream containing oxygen into said reaction zone and causing said oxygen to enter said reaction zone away from the wall thereof and internally of said outer spiralling vortex and reacting said oxygen with said first stream thereby producing a gaseous product comprising carbon dioxide and producing a heated particulate carbonaceous material;
d. removing a third stream from said reaction zone containing said gaseous product and said carrier gas which is substantially free of said particulate carbonaceous material within a period of time sufficiently short that the carbon monoxide content of said third stream is less than carbon monoxide content of said first and second streams; and e. removing a fourth stream containing said heated particulate carbonaceous material which is a major portion of said particulate carbonaceous material introduced in step (a), from said reaction zone.

16. A process for heating particulate carbonaceous material, as recited in claim 15, wherein said second stream is introduced into said reaction zone along the axis of said reaction zone and wherein said third stream is caused to be removed concentric to said second stream and isolated therefrom.

17. A process for heating particulate carbonaceous material, as recited in claim 15, wherein said second stream is introduced into said reaction zone along the axis of said reaction zone and wherein said fourth stream is caused to be removed surrounding said second stream and isolated therefrom.

18. A process for heating particulate carbonaceous material, as recited in claim 15, wherein said second stream is introduced into said reaction zone in an annular flow pattern about said third stream and isolated therefrom.

19. A process for heating particulate carbonaceous material, as recited in claim 18, wherein said annular flow pattern is also swirling.

20. A process for heating particulate carbonaceous material, as recited in claim 15, wherein said first stream has a temperature of at least 1200° F.

21. A process for heating particulate carbonaceous material, as recited in claim 15, wherein said particulate carbonaceous material is coal char.

22. A process for heating particulate carbonaceous material, as recited in claim 15, wherein said particulate carbonaceous material is the solid product from the carbonization of waste material.

23. A process for heating particulate carbonaceous material, as recited in claim 15, wherein said particulate carbonaceous material is the solid product from the carbonization of municipal solid waste.

* * * * *

UNITED STATES PATENT AND TRADEMARK OFFICE

CERTIFICATE OF CORRECTION

PATENT NO. : 4,101,263

DATED : July 18, 1978

INVENTOR(S) : Robert E. Lumpkin, Jr.

It is certified that error appears in the above-identified patent and that said Letters Patent are hereby corrected as shown below:

Column 7, line 65, which is the first line of claim 2, the word "gaseous" should read -- nongaseous --.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*